US007114871B2

(12) United States Patent
Thiebaut

(10) Patent No.: US 7,114,871 B2
(45) Date of Patent: Oct. 3, 2006

(54) PACKAGING AND APPLICATION DEVICE FOR A PRODUCT, NOTABLY A NAIL VARNISH REMOVER

(75) Inventor: Laure Thiebaut, Clichy (FR)

(73) Assignee: L'Oreal, (FR)

( * ) Notice: Subject to any disclaimer, the term of this patent is extended or adjusted under 35 U.S.C. 154(b) by 0 days.

(21) Appl. No.: 10/626,899

(22) Filed: Jul. 22, 2003

(65) Prior Publication Data

US 2004/0213628 A1 Oct. 28, 2004

Related U.S. Application Data

(60) Provisional application No. 60/407,307, filed on Sep. 3, 2002.

(30) Foreign Application Priority Data

Jul. 24, 2002 (FR) ..... 02 09385

(51) Int. Cl.
*B43K 5/00* (2006.01)

(52) U.S. Cl. ..... 401/205; 401/202

(58) Field of Classification Search ..... 401/202, 401/205, 280, 281, 270
See application file for complete search history.

(56) References Cited

U.S. PATENT DOCUMENTS 2,409,933 A 10/1946 Fleisher et al.
3,106,742 A 10/1963 Schultz et al.
3,281,887 A 11/1966 Raffe
3,390,941 A * 7/1968 Wolfgang ..... 401/205
3,592,202 A * 7/1971 Jones ..... 132/313
4,279,527 A 7/1981 Moe et al.
4,747,720 A 5/1988 Bellehumeur et al.
5,230,579 A 7/1993 Klawson et al.
6,328,040 B1 * 12/2001 Stein ..... 132/74.5

FOREIGN PATENT DOCUMENTS

FR 2 681 050 A1 3/1993

* cited by examiner

*Primary Examiner*—David J. Walczak
(74) *Attorney, Agent, or Firm*—Lerner, David, Littenberg, Krumhol z& Mentlik, LLP

(57) ABSTRACT

A packaging and application device for a product, specifically a cosmetic product. The device includes a receptacle for cleaning the product having a longitudinal axis and a passageway. The receptacle also includes a porous or fibrous applicator element capable of communicating with the product in the receptacle through the passageway. A dispensing element adapted for opening and closing the passageway. The device further contains a dispensing element adapted for opening and closing the passageway and includes a mobile part rotatable about the longitudinal axis between a first position in which the passage is closed and a second position in which the passage is open. The device also includes a closure cap capable of engaging a dispensing element.

31 Claims, 5 Drawing Sheets

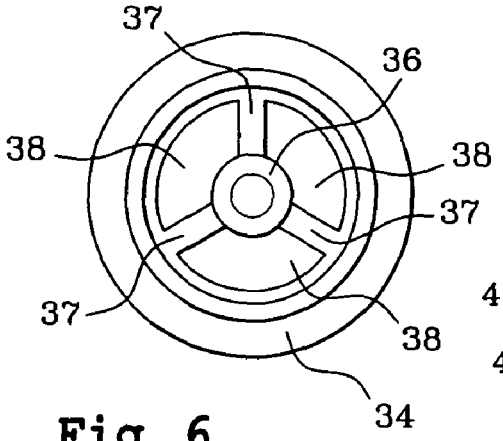
Fig. 6
Fig. 7
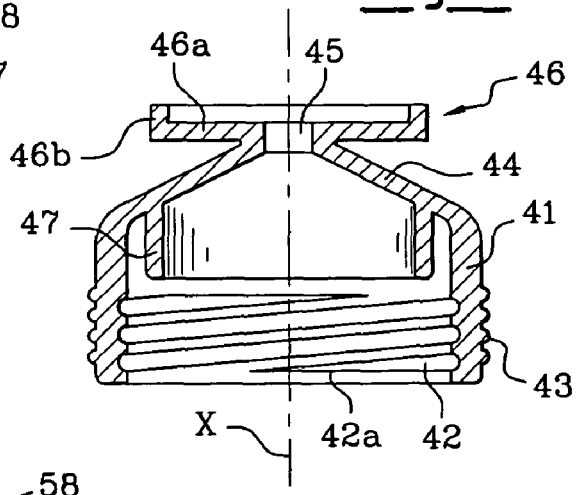
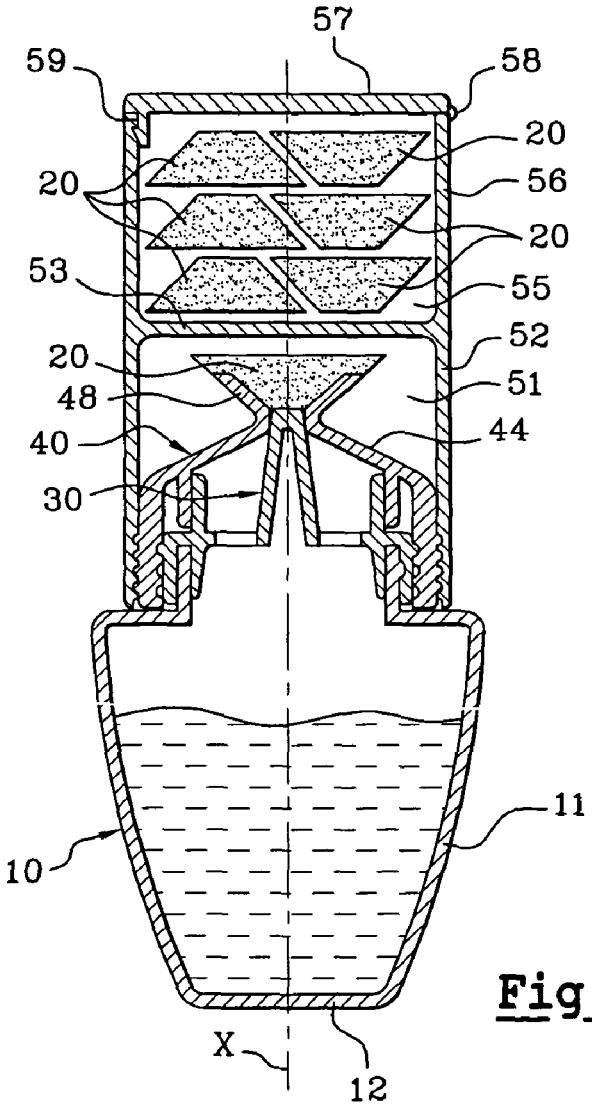
Fig. 8
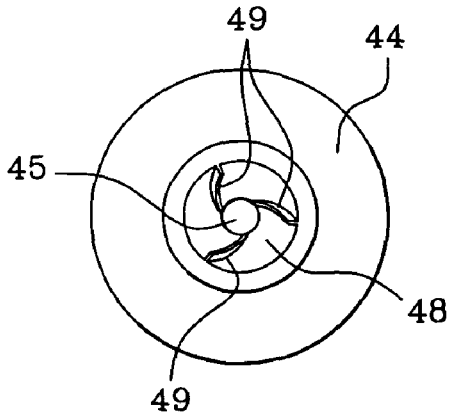
Fig. 9

PACKAGING AND APPLICATION DEVICE FOR A PRODUCT, NOTABLY A NAIL VARNISH REMOVER

BACKGROUND OF THE INVENTION

The invention disclosed relates to a packaging and application device for a product, in particular a fluid product such as for example nail varnish remover.

Nail vanish remover products are for the most part packaged in bottles and require the use of a cotton wool swab for their application. Wipes impregnated with remover also exist which have the advantage of being more readily transportable. However, these two types of application have the major drawback that it is difficult to remove the varnish from a nail on one hand without damaging the varnish on the other nails of both hands, particularly the hand in which the cotton wool swab or wipe is being held. It often happens that the varnish on a single nail is damaged and it is needed to remove the varnish from this nail only without re-applying varnish to both hands. Similarly, when it is desired to remove the varnish from the toenails, the use of a cotton wool swab or wipe impregnated with remover removes the varnish from the nails of the hand holding the swab or wipe.

For this reason, the need has arisen for an applicator device for a nail varnish remover product which can be used to remove the varnish from a single nail if desired, without removing the varnish from the other nails.

In particular, the need has arisen for a device of the type which includes a receptacle containing the product and an applicator element capable of communicating with the product contained in the receptacle through a passage which can be opened or closed in response to the actuation of an intermediate element placed between the applicator and the receptacle.

Numerous application devices of this type have already been described for other types of products.

In particular, U.S. Pat. No. 4,279,527 describes a device including a bottle onto which is screwed a collar integral with an applicator brush. When the collar is screwed to its maximum extent onto the bottle, the brush is isolated from the inside of the bottle by means of a centre-post which blanks off a communicating aperture between the bottle and brush. To use the device, the user unscrews the collar which moves the aperture away from the centre-post thereby providing sufficient clearance to allow the product to pass from the bottle to the brush. In this device, no closure cap is provided to cover the brush in the closed position so that the brush is not protected.

U.S. Pat. No. 2,409,933 describes in one of the embodiments a bottle including an outlet aperture formed outside the longitudinal axis of the bottle, and which is surmounted by an applicator having an inlet aperture also formed outside the longitudinal axis of the bottle. A cap is provided to cover the applicator in the closed position. In the closed position, the two apertures are offset in such a way that the product cannot reach the applicator. To place the applicator in communication with the product, the user removes the cap then turns the applicator so as to bring the two apertures into alignment with each other. To close the device, the user must first turn the applicator to place the two apertures in the offset position, then replace the cap. Two separate movements are thus necessary both to open and close the device.

In certain devices, the cap serving to protect the applicator is also used to close the passage allowing communication between the inside of the receptacle and the applicator. This is notably the case in the device described in U.S. Pat. No. 3,106,742 wherein a screwing action applied to the closure cap causes the collar integral with the applicator to move downward. However, placement of the applicator in communication with the inside of the receptacle must be done by hand, i.e. the user must first unscrew the cap then pull on the collar in order to open up the passage between the inside of the receptacle and the applicator.

In other devices, opening of the cap causes the applicator to be placed in communication with the product contained in the receptacle. This is notably the case in the devices described in U.S. Pat. No. 5,230,579 and U.S. Pat. No. 3,281,887. In U.S. Pat. No. 5,230,579, the cap is opened by means of a linear movement on the longitudinal axis of the device. When it is opened, the cap causes the movement by friction of an intermediate part carrying the applicator and the clearance of a passage aperture allowing the applicator to communicate with the product contained inside the receptacle. To shut off communication between the applicator and the product inside the receptacle, the user can use the cap to cause the intermediate part carrying the applicator to move downward on the longitudinal axis. In U.S. Pat. No. 3,281,887, the cap is screwed onto the receptacle, under a bellows formed in the neck of the receptacle. In this position, the bellows is compressed. When the cap is unscrewed, the bellows expands and a passage aperture is cleared enabling the applicator to communicate with the product inside the receptacle. When the cap is screwed back onto the receptacle, the bellows is compressed and the aperture recloses.

In these two devices, the applicator is placed in communication with the product inside the receptacle by causing a part carrying the applicator to move along the longitudinal axis of the receptacle. When the product is applied to an area to be treated, pressure is exerted on the applicator along this axis, so that the passage aperture tends to reclose as the product is being applied, which is not at all desirable.

Patent application Ser. No. FR 2 681 050 describes a device with a dispensing tip fitted with a cap in which screwing/unscrewing causes the tip to open/close. However, a dispensing tip of this kind is not suitable for the application of a nail varnish remover to remove the varnish from one nail. Moreover, unscrewing the cap causes the cap to move to the open position due to the presence of bosses on the sidewall of the tip. A configuration of this kind does not allow the cap to be screwed back onto the bottle, when the tip is closed by hand, owing to the presence of the bosses.

One of the objects of the invention is to provide a packaging and application device for a fluid product which does not have the drawbacks of the prior art.

A particular object of the invention is to provide a device which enables nail varnish to be removed from one nail without damaging the varnish on the other nails.

A further object of the invention is to provide a device which is easy to use and which enables the product and applicator to be packaged in a manner such that the applicator is isolated from the product contained in the receptacle.

A further object of the invention is also to provide a device of this kind wherein the applicator element can be changed without risk of leakage of the product from the receptacle.

SUMMARY OF THE INVENTION

According to the present invention, these objects are achieved by providing a packaging application device for a product. The packaging and application device includes a receptacle having a longitudinal axis in the passageway. The receptacle is adapted for containing various products. The packaging application device further includes a porous or fibrous applicator element capable of communicating with the product contained in the receptacle through the passageway. A dispensing element is located on the packaging device and is adapted for opening and closing the passageway. The dispensing element further includes a mobile part which may be rotated about a longitudinal axis. The mobile part is capable of moving between a first position in which the passageway is closed and a second position in which the passageway is open. The packaging device further includes a closure cap which is capable of being attachment to the dispensing element. In a preferred method, the closure cap contains threads which permits the closure cap to be screwed on to the dispensing element. The closure cap constitutes a holder for the applicator element. Additionally, the closure cap is adapted so that rotational movement of the closure cap about the longitudinal axis causes the opening and closing of the passageway.

The mobile part of the dispensing element may be moved independently of the closure cap. The closure cap may be screwed onto the dispensing element irrespective of the position of the mobile part. The mobile part may further be mobile relative to the receptacle. Only in rotation about the longitudinal axis wherein the passageway is formed remote from the longitudinal axis. Additionally, rotational movement of the mobile part relative to the receptacle may be accompanied by a linier movement of the mobile part along the longitudinal axis.

A second screw thread may be located on the dispensing element so that the mobile part may be moved relative to the receptacle by means of the second screw thread. The dispensing element may also include a fixed part having at least one wall with the passageway being closed off by engagement between the wall of the dispensing element and an opening being formed in the mobile part of the dispensing element.

The applicator element may be mounted on the packaging and applicator device in a removable or non-removable manner. Also, the holder may be adapted for obtaining an addition applicator element or even a plurality of applicator elements. The holder may be further modified in that it may be formed in the closure cap.

The applicator element may be a block of foam.

The packaging applicator device may be used to facilitate the application of a product onto human nails. Additionally, the receptacle may include a deformable wall and/or contain a cosmetic product. The cosmetic product may be adapted for the removal of a beauty product from carotene material i.e., human nails. Additionally, the device may be adapted for the use of removal of nail varnish from human nails.

BRIEF DESCRIPTION OF THE DRAWINGS

Apart from the features described above, the invention includes a number of other arrangements which are described below by way of non-limitative examples described with reference to the attached figures in which:

FIG. 6 shows a top view along arrow 6 of the collar of the device in FIG. 2;

FIG. 7 shows an axial cross-section of the applicator holder of the device illustrated in FIG. 1;

FIG. 8 shows an axial cross-section of a variant of the device in FIG. 1;

FIG. 9 shows a top view of the applicator holder of the device illustrated in FIG. 8, not containing an applicator;

DETAILED DESCRIPTION

Figure 1:
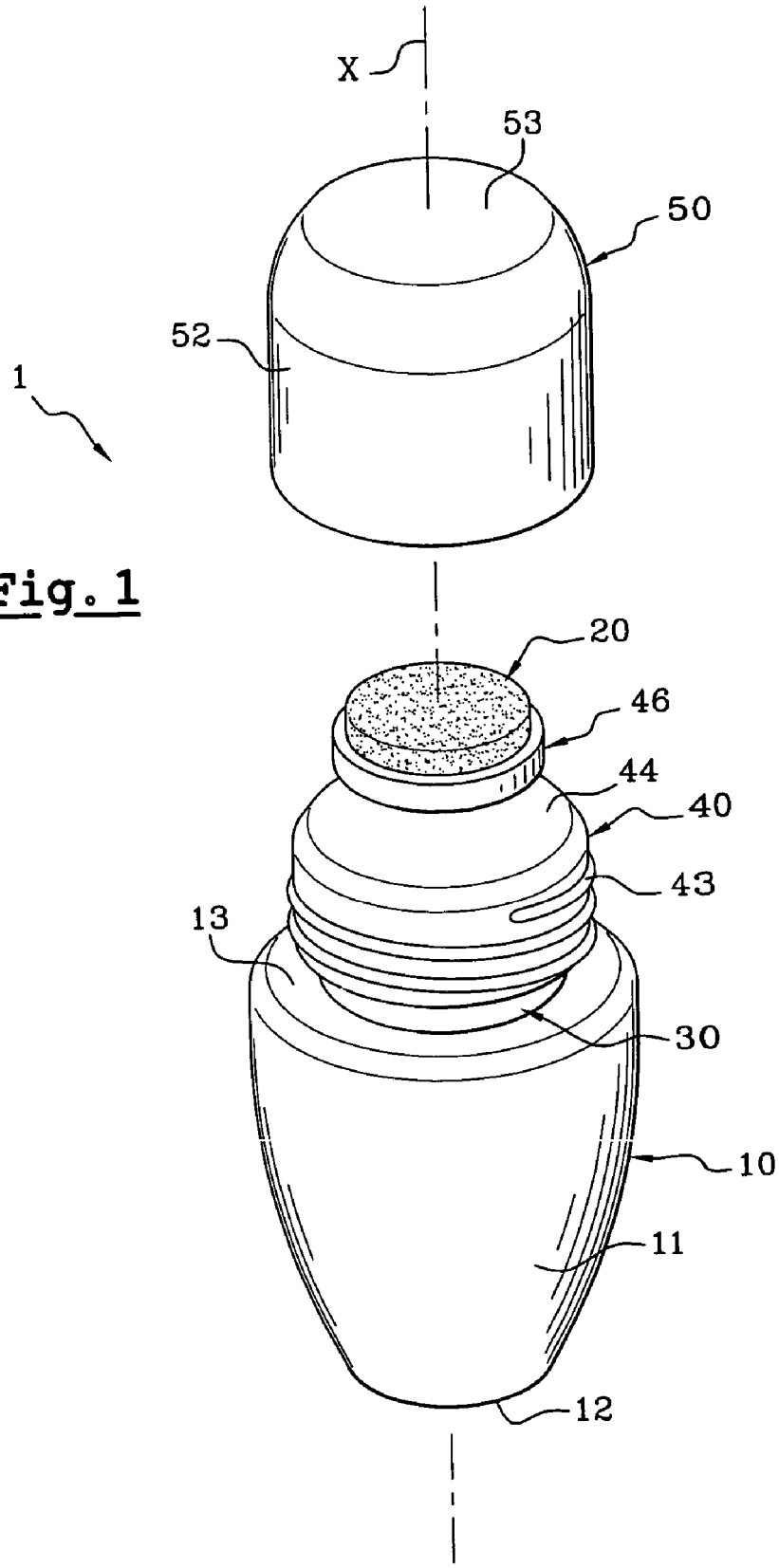
FIG. 1 shows a perspective view of the packaging and application device according to the invention.
Figure 2:
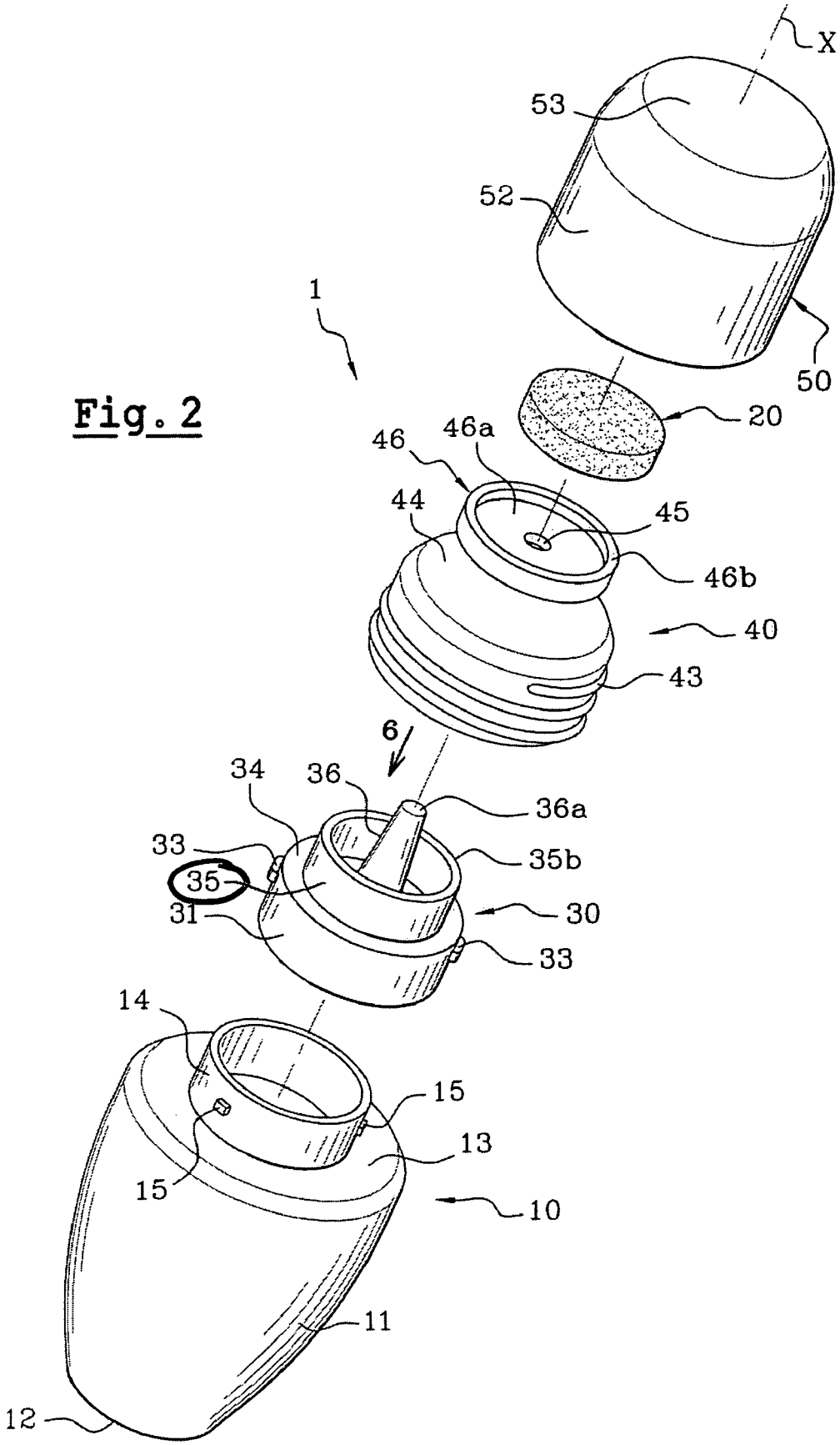
FIG. 2 shows an exploded view of the device in FIG. 1.

Throughout the description, the terms "above" and "upper position", "below" and "lower position" designate positions oriented respectively towards the top or bottom of the figures.

FIGS. 1 to 7 illustrate a packaging and application device 1 according to the invention. The device 1 includes a receptacle 10, an applicator 20 integral with the receptacle via a collar 30 and an applicator holder 40, together with a closure cap 50. The receptacle contains a fluid product, for example a nail varnish remover.

In the example illustrated, the receptacle 10 has an elongated shape along a longitudinal axis X, and includes a body formed by a side wall 11 and a bottom 12. The receptacle also includes a neck 14 centred on axis X and circular in transverse cross-section. The side wall 11 is elastically deformable and is connected to the neck 14 via a shoulder 13 which defines an annular flat surface. The neck 14 comprises three tabs 15 spaced at different angles and designed, as will be described in detail below, to hold the collar 30 on the receptacle. The receptacle 10 is, for example, made of plastic, for example polyethylene, and is obtained by moulding from a single piece.

The collar 30 is attached by a snap-on fixing to the neck 14 of the receptacle by means of a fixing skirt 31 cylindrical in shape. The fixing skirt 31 comprises three recesses 32 spaced at angles on the inner surface of the skirt, each designed to accommodate a tab 15 on the neck of the receptacle. The collar 30 is thus mounted on the receptacle without being capable of movement relative to the latter, either linearly along axis X or in rotation about axis X.

The fixing skirt 31 on the collar 30 is connected at its upper part, by means of an annular transverse wall 34, to a sealing skirt 35 concentric with the fixing skirt 31. The sealing skirt 35 includes a first portion 35*a* extending parallel to the axis X to a free lower edge. This skirt portion 35*a* is designed to be inserted into the neck 14 of the receptacle, bearing against the inner surface of the neck. The sealing skirt 35 includes a second portion 35*b* extending axially beyond the first portion, above the annular transverse wall 34, and which engages with the applicator holder 40, as will be seen in detail below.

A tapered centre-post 36 is formed on the axis X. The centre-post is connected to the sealing skirt 35 by three radial arms 37 spaced at angles and delineating, with the inner surface of the sealing skirt, apertures 38 enabling passage of the product. The centre-post 36 extends axially beyond the sealing skirt and terminates at an upper extremity 36*a* designed to fit into an opening 45 in the applicator holder 40 so as to shut off communication between the applicator and the product contained inside the receptacle.

The fixing skirt 31 on the collar comprises on its outer surface two diametrically opposing tabs 33 designed to engage with a screw thread on the applicator holder 40 to allow the applicator holder to move relative to the collar and to place the applicator 20 in communication with the product contained inside the receptacle. The engagement of the collar with the applicator holder constitutes an element to open/close the passage allowing the applicator to communicate with the product contained inside the receptacle.

The applicator holder 40 is mounted on the collar by means of a fixing skirt 41 cylindrical in shape. The fixing skirt 41 comprises a first screw thread 42 on its inner surface which engages with the tabs 33 on the collar. This engagement allows the applicator holder to be screwed/unscrewed on the collar between a first position termed the lower position and a second position termed the upper position. The first screw thread 42 is interrupted in the lower part of the skirt 41 to form a stop 42*a* for the tabs 33 so as to prevent the applicator holder from becoming detached from the collar when unscrewed to the maximum extent, i.e. in the upper position of the applicator holder on the collar. When the applicator holder is in the lower position on the collar, the screwing action is also limited as will be seen in detail below.

The fixing skirt 41 additionally includes a second screw thread 43 on its outer surface allowing attachment of the closure cap 50.

The fixing skirt 41 of the applicator holder extends at its upper part into a tapering wall 44 to an opening 45 formed on axis X opening out into a support 46 for the applicator 20. The applicator support 46 is formed by an annular transverse wall 46*a* terminating at its edge in a lateral wall 46*b* extending parallel to axis X to a free upper edge.

To prevent the product from flowing into the screw thread 42, provision is made for a sealing skirt 47 cylindrical in shape extending parallel to the axis X from the tapering wall to a free lower edge. This sealing skirt 47 is designed to form a contact seal with the upper portion 35*b* of the sealing skirt of the collar on which it slides axially when the applicator holder moves between its upper and lower positions. In the lower position, the sealing skirt 47 bears against the annular transverse wall 34 of the collar, thus limiting the downward travel of the applicator holder during the screwing action so as to prevent the fixing skirt 41 from moving past the shoulder 13 of the receptacle.

The applicator 20, mounted in the support 46, is shaped like a flat cylinder having a transverse cross-section slightly larger than the transverse cross-section of the support 46 so that the side wall 46*b* holds it laterally whilst enabling it to be withdrawn axially when it needs to be changed. When the applicator is mounted in the support, it projects axially above the side wall 46*b* of the support. It consists of a block of open-cell foam, notably a relatively flexible polyurethane foam.

Advantageously, the applicator is mounted in its support in a removable manner so that it can be readily withdrawn intact from its support and replaced by a fresh applicator or by the same applicator after cleaning, for example.

With the device in the closed position, the applicator 20 is seated in an enclosed holder 51 delimited in part by the closure cap 50 designed to close the applicator. The cap 50 consists of a peripheral skirt 52, cylindrical in shape, closed at the top by a transverse wall 53. The inner surface of the skirt 52 comprises a screw thread 54 designed to engage with the screw thread 43 on the fixing skirt 41 of the applicator holder. The free lower edge of the skirt 52 bears against the shoulder 13 of the receptacle thereby preventing the applicator 20 from being compressed in the closed position by the transverse wall 53 of the cap in the event that the screw thread is tightened excessively.

So that screwing/unscrewing of the cap 50 causes screwing/unscrewing of the applicator holder 40, the force exerted laterally by the cap 50 on the applicator holder 40 is greater than that exerted by the applicator holder 40 on the collar 30. To this end, the cap is fitted more tightly to the applicator holder than the applicator holder on the collar. Alternatively or additionally, appropriate materials are chosen to constitute the various parts, paying particular attention to the coefficient of friction or to the surface finish. Of course, the lateral force exerted by the cap on the applicator holder must still readily permit the screwing action.

Figure 3:
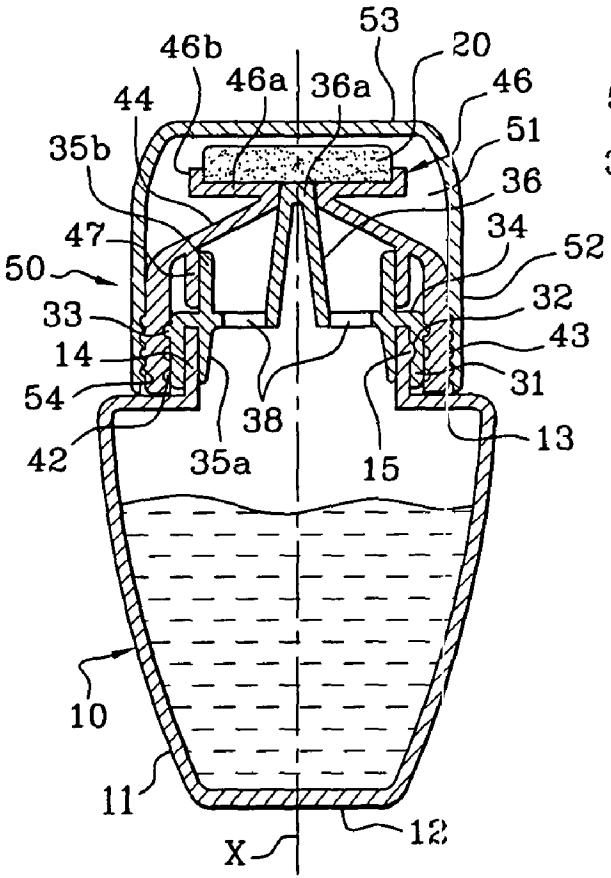
FIG. 3 shows a partial axial cross-section of the device in FIG. 1, in the closed position.

In the closed position illustrated in FIG. 3, the cap 50 is screwed onto the applicator holder by the engagement of complementary screw threads 54 and 43 respectively comprised on the cap and applicator holder. The applicator holder 40 is in the lower position relative to the collar 30, i.e. the tabs 33 are located in the upper part of the screw thread 42. The upper extremity 36*a* of the centre-post 36 is seated in the opening 45 in the applicator holder so as to prevent any communication of the product contained in the receptacle with the applicator.

Figure 4:
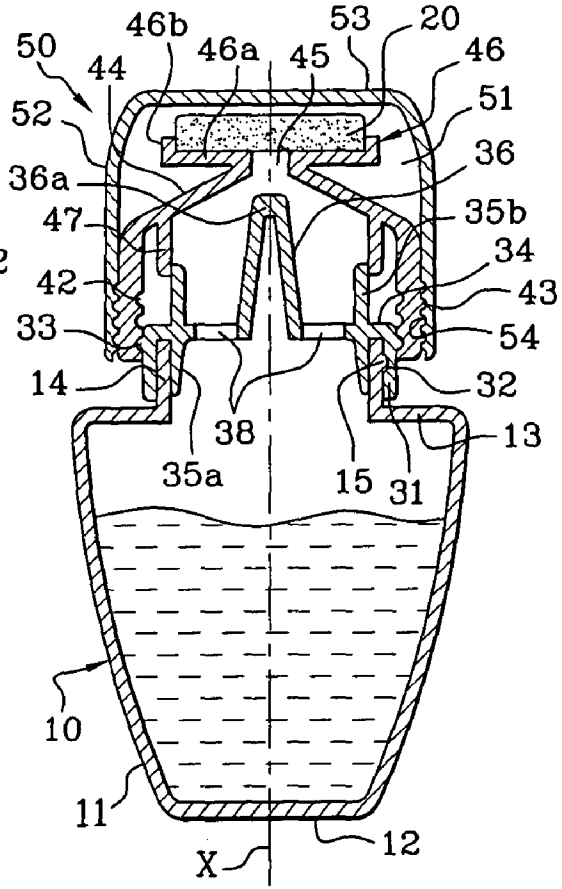
FIG. 4 shows a partial axial cross-section of the device in FIG. 1, in the process of opening.

To open the device, the user rotates the cap 50 relative to the receptacle, which, in the first instance, unscrews the applicator holder and displaces the applicator holder axially relative to the collar as illustrated in FIG. 4. The applicator holder 40 is then in the upper position relative to the collar 30, i.e. the tabs 33 are situated in the lower part of the screw thread 42 and are brought to bear against the extremity 42*a* of the thread. The opening 45 is then cleared to allow the product contained in the receptacle to communicate with the applicator.

Figure 5:
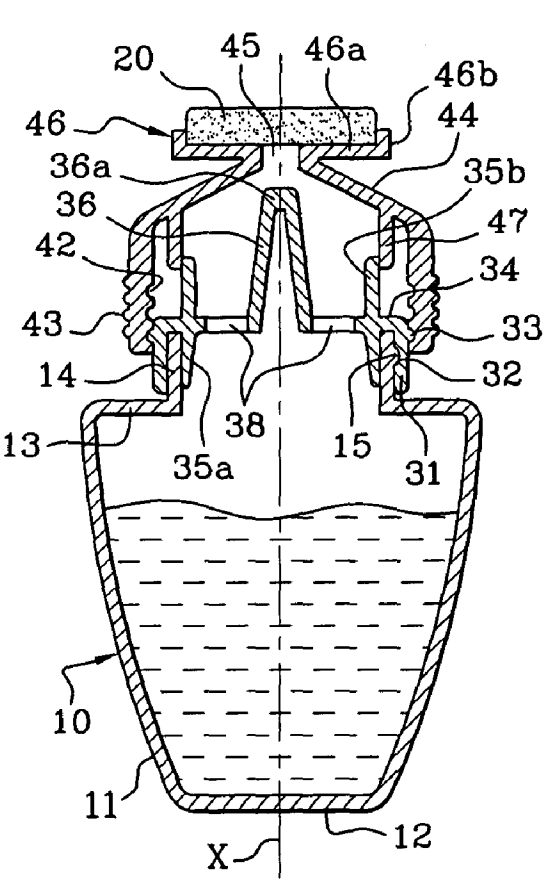
FIG. 5 shows a partial axial cross-section of the device in FIG. 1, in the open position.

The user then continues the unscrewing action, in this instance to unscrew the cap of the applicator holder so as to release the applicator, as illustrated in FIG. 5. The user is then able to place the applicator on a nail with the device positioned head downward, i.e. by placing the applicator below the receptacle so that the product flows by gravity into the applicator via the apertures 38 and the opening 45. If the user wants the product to flow more quickly into the applicator, she may exert light pressure on the side wall 11 of the receptacle thereby pushing the product towards the applicator 20. She may also use the device in a position with the head uppermost, pushing the product towards the applicator by pressing on the side wall 11 of the receptacle. Once the applicator is soaked with the product, the user can apply circular movements on the nail in order to remove the varnish. When the application is finished, the user places the cap 50 on the applicator holder 40 and rotates the cap relative to the receptacle 10, during which the applicator holder 40 is screwed back into the collar 30, until it is in its lower position and the cap is screwed back onto the applicator holder until it is brought to bear against the shoulder 13 of the receptacle.

When, after using the device to remove nail varnish, the user considers that the applicator is excessively soiled and needs to be replaced, she screws the applicator holder into the collar by hand, i.e. without the cap, so as to block the opening 45 by the centre-post 36. With no risk of leakage of the product, she can then easily withdraw the applicator from its support 46 and replace it with a fresh one. Alternatively, she can wash the applicator just removed and replace it in the support. The user can then screw the cap back onto the applicator holder which is in its lower position because the screw thread will permit this action.

FIGS. 8 and 9 illustrate a variant of the device described above with reference to FIGS. 1 to 7 and which is used in the same manner.

According to this variant, receptacle 10 and the collar 30 are identical to the receptacle and collar in the first embodiment. The applicator holder 40 differs from the applicator holder in the first embodiment by the shape of the applicator support 46. The support 46 in this case is formed by a tapered wall 48 which tapers from the opening 45 towards the outside. The tapered wall 48 comprises three projections 49 which serve to hold the applicator 20 laterally whilst allowing it to be withdrawn axially when it needs to be changed. The applicator 20 in this case is wedge-shaped.

In this embodiment, the cap 50 defines a second holder 55 delimited by an axial extension 56 of the peripheral skirt 52, above the transverse wall 53, closed in a reversible manner at its upper part by a transverse wall 57 arranged to pivot on a film hinge 58. A latching arrangement 59, diametrically opposite the film hinge 58, is provided to latch the transverse wall 57 onto the extension 56 of the skirt so as to keep the second holder 55 closed. The second holder 55 can accommodate several applicators 20 which are designed to successively replace the applicator previously used.

Figure 11:
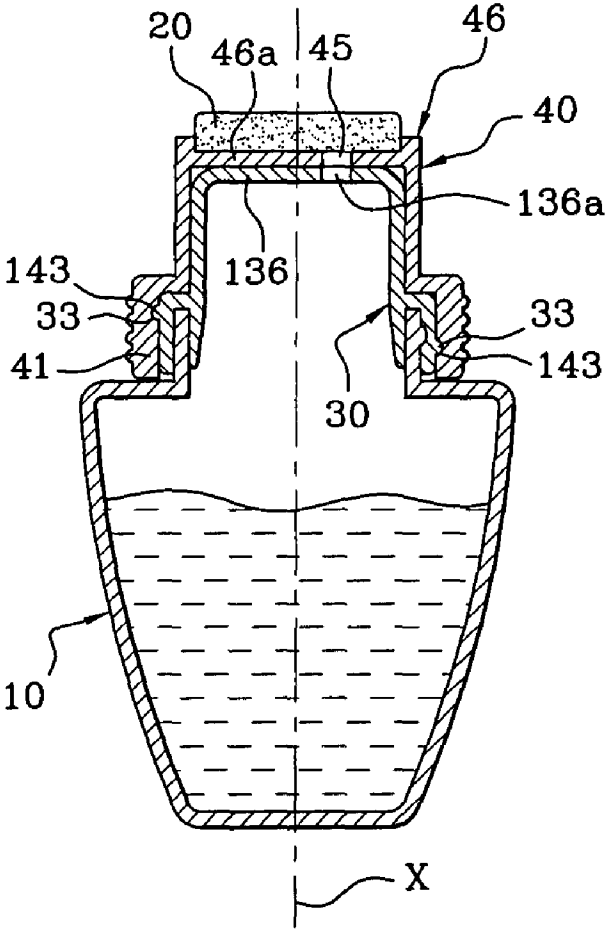
FIG. 11 shows an axial cross-section of the second embodiment of the device according to the invention, in the open position.
Figure 10:
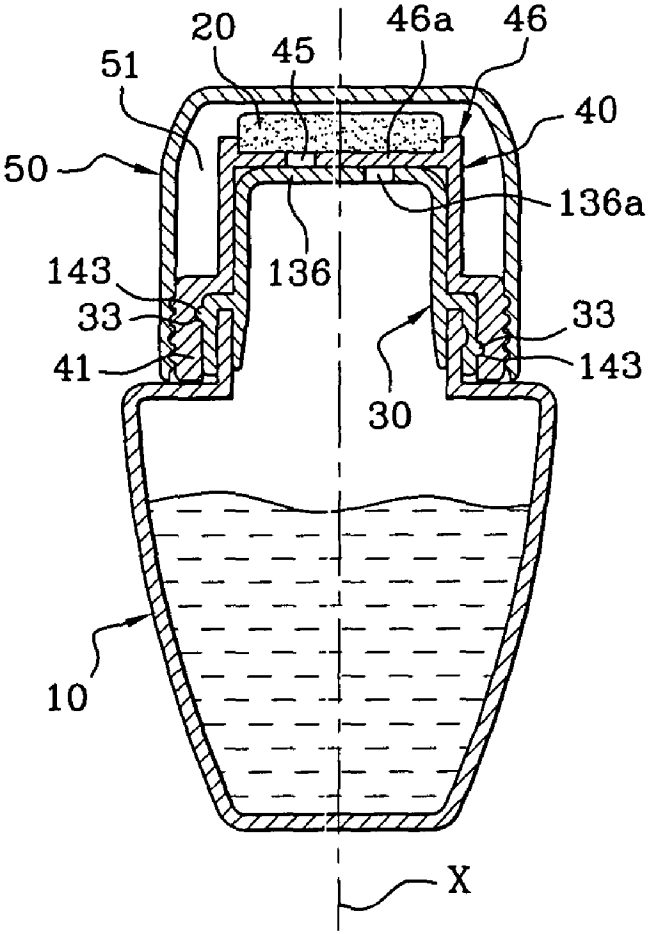
FIG. 10 shows an axial cross-section of a second embodiment of a device according to the invention, in the closed position.

The embodiment illustrated in FIGS. 10 and 11 differs from the first embodiment illustrated in FIGS. 1 to 7 principally in that the applicator holder 40 is mobile relative to the collar only in rotation about the axis X.

The screw thread on the inner surface of the fixing skirt 41 on the applicator holder is replaced by two grooves 143, diametrically opposed, in which the tabs 33 move. The two tabs 33 are in this case formed at different axial heights. The grooves 143 are also formed at different axial heights and each extend in a transverse plane relative to axis X, in an angular portion of approximately 180° thereby allowing the applicator holder to move through 180° relative to the collar 30. The opening 45 in the support 46 is in this case formed outside the axis X.

The centre-post of the collar is replaced by a transverse wall 136 formed from the axial extension of the sealing skirt 35, and which forms a contact seal with the transverse wall 46*a* of the support 46. The transverse wall 136 comprises an orifice 136*a* also formed outside the axis X. The orifice 136*a* is situated in the wall 136 in a manner such that the opening 45 in the applicator holder is aligned with the orifice 136*a* when the tabs 33 bear against one extremity of their respective groove.

In this embodiment, in the closed position illustrated in FIG. 10, the cap 50 is screwed onto the applicator holder and the wall 136 blocks the opening 45 to prevent any communication between the product contained in the receptacle and the applicator. The tabs 33 are each located at a first extremity of their respective groove.

To open the device, the user rotates the cap 50 relative to the receptacle, which in the first instance causes the tabs 33 to move in their respective groove 143 from the first extremity of the groove to the second extremity, as in this case also the force exerted laterally by the cap 50 on the applicator holder 40 is greater than the force exerted by the applicator holder 40 on the collar 30. The applicator holder thus moves through 180° relative to the collar so that the opening 45 in the applicator holder is aligned with the orifice 136*a* in the wall 136 thereby allowing the product contained in the receptacle to communicate with the applicator.

The user then continues the unscrewing action, in this instance unscrewing the cap from the applicator holder in order to release the applicator, as illustrated in FIG. 11.

In the foregoing detailed description, reference is made to preferred embodiments of the invention. It is evident that variants can be introduced thereto without departing from the spirit of the invention as claimed below.

The invention claimed is:

1. A packaging and application device for a product, the device comprising:

a receptacle having a longitudinal axis and a passageway, said receptacle adapted for containing the product;

a porous or fibrous applicator element capable of communicating with the product contained in said receptacle through said passageway;

a dispensing element adapted for opening and closing said passageway, said dispensing element including a mobile part rotatable about said longitudinal axis and movable, wherein said mobile part is capable of moving between a first position in which said passageway is closed and a second position in which said passageway is open, wherein rotational movement of said mobile part relative to said receptacle is accompanied by a linear movement of said mobile part along said longitudinal axis; and a closure cap capable of attachment by means of a screw thread onto said dispensing element, wherein said closure cap constitutes an enclosed holder for said applicator element, wherein rotational movement of said closure cap about said longitudinal axis causes the opening and closing of said passageway.

2. The device according to claim 1, wherein said mobile part of said dispensing element is capable of moving independently of said closure cap.

3. The device according to claim 1, wherein said closure cap is capable of being screwed onto said dispensing element irrespective of the position of said mobile part.

4. The device according to claim 1, wherein said mobile part is mobile relative to said receptacle in rotation only about said longitudinal axis, wherein said passageway is remote from said longitudinal axis.

5. The device according to claim 1, further comprising a screw thread located on said dispensing element, wherein said mobile part is mobile relative to said receptacle by means of said screw thread.

6. The device according to claim 1, wherein said dispensing element includes a fixed part having at least one wall, wherein said passageway is closed off by engagement between said wall of said dispensing element and an opening is formed in said mobile part of said dispensing element.

7. The device according to claim 1, wherein said applicator element is mounted on the device in a removable manner.

8. The device according to claim 1, further comprising a holder adapted for containing at least one additional applicator element.

9. The device according to claim 8, wherein said holder contains a plurality of said applicator elements.

10. The device according to claim 8 or 9, wherein said holder is formed in said closure cap.

11. The device according to claim 1, wherein said applicator element is a block of foam.

12. The device according to claim 1, wherein the device is adapted to facilitate the application of a product onto human nails.

13. The device according to claim 1, wherein said receptacle comprises a deformable wall.

14. The device according to claim 1, wherein said receptacle contains a cosmetic product.

15. The device according to claim 14, wherein said cosmetic product is adapted for the removal of a beauty product from keratin material.

16. Use of a device according to claim 1 for the removal of nail varnish.

17. A packaging and application device for a product, the device comprising:

a receptacle having a longitudinal axis and a passageway, said receptacle adapted for containing the product;

a porous or fibrous applicator element capable of communicating with the product contained in said receptacle through said passageway;

a dispensing element adapted for opening and closing said passageway, said dispensing element including a mobile part rotatable about said longitudinal axis and movable, wherein said mobile part is capable of moving between a first position in which said passageway is closed and a second position in which said passageway is open; and a closure cap capable of attachment by means of a screw thread onto said dispensing element, wherein said closure cap constitutes an enclosed holder for said applicator element, wherein rotational movement of said closure cap about said longitudinal axis causes the opening and closing of said passageway, wherein rotational movement of said mobile part relative to said receptacle is accompanied by a linear movement of said mobile part along said longitudinal axis, said dispensing element further including a screw thread, wherein said mobile part is mobile relative to said receptacle by means of said screw thread.

18. The device according to claim 17, wherein said mobile part of said dispensing element is capable of moving independently of said closure cap.

19. The device according to claim 17, wherein said closure cap is capable of being screwed onto said dispensing element irrespective of the position of said mobile part.

20. The device according to claim 17, wherein said mobile part is mobile relative to said receptacle in rotation only about said longitudinal axis, wherein said passageway is remote from said longitudinal axis.

21. The device according to claim 17, wherein said dispensing element includes a fixed part having at least one wall, wherein said passageway is closed off by engagement between said wall of said dispensing element and an opening is formed in said mobile part of said dispensing element.

22. The device according to claim 17, wherein said applicator element is mounted on the device in a removable manner.

23. The device according to claim 17, further comprising a holder adapted for containing at least one additional applicator element.

24. The device according to claim 23, wherein said holder contains a plurality of said applicator elements.

25. The device according to claim 23 or 24, wherein said holder is formed in said closure cap.

26. The device according to claim 17, wherein said applicator element is a block of foam.

27. The device according to claim 17, wherein the device is adapted to facilitate the application of a product onto human nails.

28. The device according to claim 17, wherein said receptacle comprises a deformable wall.

29. The device according to claim 17, wherein said receptacle contains a cosmetic product.

30. The device according to claim 29, wherein said cosmetic product is adapted for the removal of a beauty product from keratin material.

31. Use of a device according to claim 17 for the removal of nail varnish.

* * * * *